US005484070A

United States Patent [19]

Graham

[11] Patent Number: 5,484,070

[45] Date of Patent: Jan. 16, 1996

[54] CHILD-PROOF CLOSURE WITH SYRINGE-TIP CONNECTOR

[76] Inventor: D. Scott Graham, 6815 Dillon Hills Dr., Nashport, Ohio 43830

[21] Appl. No.: 209,270

[22] Filed: Mar. 14, 1994

[51] Int. Cl.[6] ..... B65D 5/43; B65D 51/18; B65D 55/02

[52] U.S. Cl. ..... 215/223; 215/237; 215/217; 220/259; 220/339; 604/905; 222/568

[58] Field of Search ..... 215/204, 205, 215/214, 217, 218, 219, 220, 235, 237, DIG. 3, 223; 220/339, 254, 256, 259; 604/905, 407; 222/376, 386, 464, 568

[56] References Cited

U.S. PATENT DOCUMENTS

| | | | |
|---|---|---|---|
| 3,033,203 | 5/1962 | Barton | 215/DIG. 3 |
| 3,940,003 | 2/1976 | Larson . | |
| 3,977,555 | 8/1976 | Larson . | |
| 4,209,100 | 6/1980 | Uhlig . | |
| 4,378,073 | 3/1983 | Luker . | |
| 4,533,058 | 8/1985 | Uhlig . | |
| 4,629,081 | 12/1986 | McLaren | 215/237 X |
| 4,811,600 | 3/1989 | Robitaille . | |
| 4,940,167 | 7/1990 | Fillmore et al. . | |
| 5,029,719 | 7/1991 | Soloman | 220/707 X |
| 5,065,876 | 11/1991 | Joyce . | |
| 5,088,984 | 2/1992 | Fields | 604/905 X |
| 5,143,234 | 9/1992 | Lohrman et al. | 215/237 X |
| 5,207,657 | 5/1993 | Gibilisco . | |
| 5,251,873 | 10/1993 | Atkinson et al. | 604/905 X |

*Primary Examiner*—Stephen P. Garbe
*Assistant Examiner*—Nathan Newhouse
*Attorney, Agent, or Firm*—Killworth, Gottman, Hagan & Schaeff

[57] ABSTRACT

A container closure having syringe tip connector is provided which comprises a coupling for securing the closure to the container, a dispensing port for releasably connecting the tip of a syringe and a cap for sealing the dispensing port. The closure has dual child-resistant capability in a "push and turn" mechanism for securing the coupling to the container and a latching flap type lid on the cap. The closure is especially useful for aspirating medication into a syringe for oral administration to children, adults or animals.

19 Claims, 4 Drawing Sheets

CHILD-PROOF CLOSURE WITH SYRINGE-TIP CONNECTOR

BACKGROUND OF THE INVENTION

This invention relates to a closure for liquid medication containers, and in particular to a child-proof closure with a syringe-tip connector for withdrawing medication directly from a container.

The majority of children under the age of four are given liquid oral medication for the treatment of ailments. Oral medication is easier to swallow when in a liquid form rather than in a tablet form, and, quite frequently, is better tasting. One of the most common means of administering oral medications to small children is through the use of a syringe.

There are currently at least two methods in which liquid medication can be withdrawn into the syringe. In a first method, the syringe is placed into the medication container, submerged in the medication, and the medicine withdrawn into the syringe. This method has several drawbacks. Placement of the syringe into the medication container can lead to contamination of the medication. Further, medication is wasted due to droplets clinging to the outside of the syringe when it is removed form the container. A second method involves pouring an amount of medicine from the medication container into a cup or temporary reservoir. The medication is then withdrawn into a syringe from this temporary reservoir. This method also has several drawbacks. Transfer of medicine to the temporary reservoir increases the chances of spillage and waste. Again, submersion of the syringe into the medication can lead to contamination problems. Lastly, medicine remaining in the temporary reservoir must be discarded as readdition to the medication container is another means of potential contamination. Discarding this excess medicine presents another form of wastage of medication.

As many small children are known to be of the curious sort, oral medication containers are highly desirous in a child-proof form. Supplying medication for home use in child-proof containers dramatically decreases the potential for accidental spillage or more importantly accidental overdosage. Thus, a preferred medication container for small children includes both child-proof attributes as well as means for conveniently dispensing liquid medication.

Various closures have been utilized in the prior art in order to combine child-proof function with dispensing of liquid medication. Examples of closures with these attributes include U.S. Pat. No. 4,209,100, U.S. Pat. No. 4,533,058 and U.S. Pat. No. 4,940,167.

U.S. Pat. No. 4,209,100 issued Jun. 24, 1980 to Uhlig, discloses a safety closure for containers of harmful products. The closure contains a flush-top safety cap which is disengaged by pushing in one side of the container thereby raising the flush-top and allowing it to be raised by one's fingernails. The closure has a port in the top surface for pouring liquids. The flush-top has an extension protruding from its bottom to seal the port when the flush-top is closed. The patent does not disclose a port capable of allowing a syringe to be attached to withdraw medication directly from the container.

U.S. Pat. No. 4,533,058 issued Aug. 6, 1985 also to Uhlig, discloses a safety cap with a flush-top which latches to the side wall. The safety cap is disengaged by depressing one end of the flush-top thereby unlatching the flush-top allowing it to be raised. The closure contains a port in the top surface for pouring liquids. The finish-top has an extension protruding from its bottom allowing the port to be sealed when the flush-top is closed. Again, however, the patent does not disclose a port capable of allowing a syringe to be attached to withdraw medication from the container.

U.S. Pat. No. 4,940,167 issued Jul. 10, 1990 to Fillmore et al, discloses a safety cap with a flush-top that latches to the side wall of the safety cap. The safety cap is disengaged by pushing in a side wall of the safety's cap thereby raising the flush-top and unlatching it so that the top can be raised. The safety cap includes a port on the top for pouring liquids. The patent does not disclose either a port capable of allowing a syringe to be attached to withdraw medication from the container or a plug connected to the flush-top to seal the port when the flush-top is closed.

Accordingly, a need exists for an improved child-proof closure which allows oral liquid medications to be drawn directly from the container into a syringe for administration.

SUMMARY OF THE INVENTION

The present invention solves this need by providing a container closure which allows oral liquid medication to be drawn directly from the container which it is secured to. The closure of the present invention achieves direct dispensing into a syringe by including a dispensing port for the medication that functions as a syringe tip connector. Further, the closure can be a one-piece or, more preferably a two-piece child resistant container closure.

In accordance with the present invention, there is provided a container closure having a syringe tip connector. The closure includes a coupling which allows the closure to be secured to the opening of a container. The closure also includes a dispensing port which functions to releasably connecting the tip of a syringe. The dispensing port is comprised of a tubular stem extending upwardly from the coupling. The closure also has a cap encircling the coupling which is adapted for movement between open and closed positions. The cap has a plug member so that when the cap is closed, the plug seals the dispensing port and no liquid may spill.

In one embodiment of the present invention, a flange extends outwardly from the tubular stem. This flange allows the tip of the syringe to rotatably engage the tubular stem, and thus, the closure. In a second embodiment, the tubular stem is adapted for a friction fit to a syringe with a conical tip. The dispensing port may further include a tube affixed to the tubular stem at a first end. The other end of the tube, the second end, may either be furcated or extended to the bottom of the container when the cap is secured to the container. This allows medication to be withdrawn without inverting the container. Lastly, the tube may also have a flow control device, such as a valve, with which to control the flow of liquid out of the container.

The coupling comprises a laterally extending top panel with a skirt descending from the top panel. The skirt may be annular in which case the top panel is also annular. Further, the skirt may have internally extending ridges or threads by which the closure can be rotatably secured to a threaded container opening.

In accordance with an additional aspect of the present invention, there is provided a two-piece child resistant container closure. In this aspect of the invention, the cap comprises an outer barrel member which is adapted to fit over the coupling. The outer barrel has free rotation around the coupling, but limited axial movement either up and down or out away from the coupling. The outer barrel member includes a base portion encircling said coupling, an upwardly extending annular side wall, an internally extending flange intermediate to the base and upwardly extending side wall and a lid spanning the upwardly extending side wall.

In the child resistant closure of the present invention, the top panel of the coupling has engagement members. The internally extending flange of the outer barrel then has complimentary engagement members opposing the engaging members of the top panel of the closure. The engagement members can be selected from the group consisting of ridges, ribs or inclined planes.

These engagement members are aligned such that when the outer barrel member is depressed and rotated, the opposing engagement members interlock causing the coupling and the outer barrel member to move in conjunction. This allows the closure to be removed from the container. Without depression of the outer barrel member, the outer barrel and the coupling do not interlock, the outer barrel rotates freely around the coupling and the closure can not be removed from the container.

The lid of the outer barrel comprises a flap. The flap is hinged to a side of the annular side wall and has a fastener on the distal end. The fastener is adapted for latching onto the opposite side of the annular wall. The opposite side of the annular wall from the hinge of the flap is then notched in order to receive the fastener.

This latching mechanism may comprise a second child resistant feature of the present invention. The annular side wall which contains the notch to receive the fastener can be manufactured to be thinner than the remainder of the annular side wall. This will result in this portion of the side wall being flexible while the remainder is rigid. Depressing the flexible side wall will release the fastener from the notch and allow the flap to be raised.

Accordingly, it is an object of the present invention to provide a container closure which allows medication to be directly withdrawn from the container into a syringe through the use of a syringe tip connector. It is still another object of the present invention to provide a container closure with a syringe tip connector that is a two-piece child resistant closure with a child resistant flip-top. Other objects and advantages of the invention will be apparent from the following description, the accompanying drawings, and the appended claims.

DETAILED DESCRIPTION OF THE PREFERRED EMBODIMENTS

The present invention comprises a container closure having a syringe tip connector for directly dispensing medication into a syringe from the container. The closure is adapted to fit different types of syringes such as a Luer-Lok syringe or a standard tip, non Luer-Lok syringe. The closure has dual functioning capabilities. It can be used by either removing completely to pour medicine from the container into another holding device such as a spoon or it can be used by opening the flip-top, attaching a syringe and aspirating medication from the container. The present invention and its attendant advantages will be further described by reference to the accompanying figures.

Figure 1:
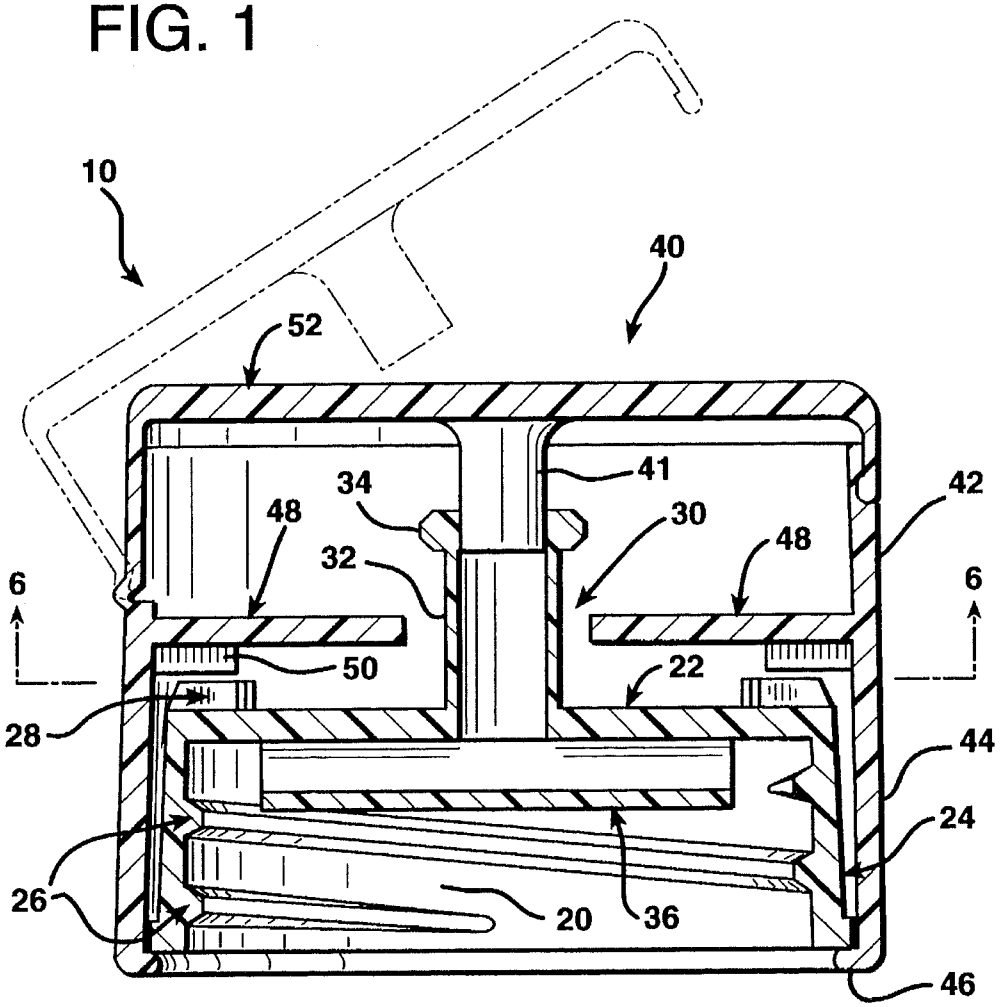
FIG. 1 is a sectional view illustrating the preferred embodiment according to the present invention.

Referring to FIG. 1, there is seen a sectional view of the closure 10 of the present invention. As previously mentioned, the closure consists of a coupling 20, a dispensing port 30 and a cap 40. All three elements may be molded into a single component (not shown) or, as is preferred, the closure may be of a two piece design as shown in FIG. 1.

Coupling 20 is the inner piece of the two-piece closure as shown. Coupling 20 includes a top panel 22 and a skirt 24. In a preferred design, the closure of the present invention is annular. Thus, skirt 24 is preferably annular and top panel 22 is preferably circular. Coupling 20 may further include internal ridges 26 or threads by which the closure may be secured to a threaded container opening. However, it is within the scope of this invention that closure 10 may be secured to a container by means other than threads such as, for example, by friction fit.

Figure 2:
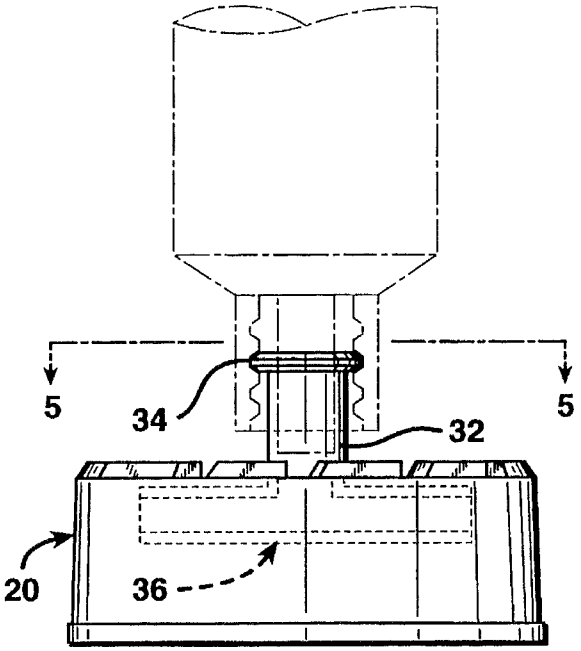
FIG. 2 is a side view illustrating a Luer-Lok tip syringe connected to the dispensing port according to the present invention.

Dispensing port 30 is attached to coupling 20 as is shown. Dispensing port 30 comprises a tubular stem 32 extending upward from the top panel 22 of the coupling. The length of the tubular shaft can be any-desired but is preferably approximately ⅜ inches above top panel 22. In a first embodiment, as can be seen in FIG. 2, a flange 34 extends out from the tubular stem and acts as a thread. A syringe tip of the Luer-Lok design can be rotatably attached to flange 34. Tubular stem 32 can include internal adaption 35 such that a standard tip, non Luer-Lok syringe may be inserted into tubular stem 32 with a press fit attachment. Thus, tubular stem 32 is functional with both a Luer-Lok syringe or a standard tip, non Luer-Lok syringe.

Figure 3:
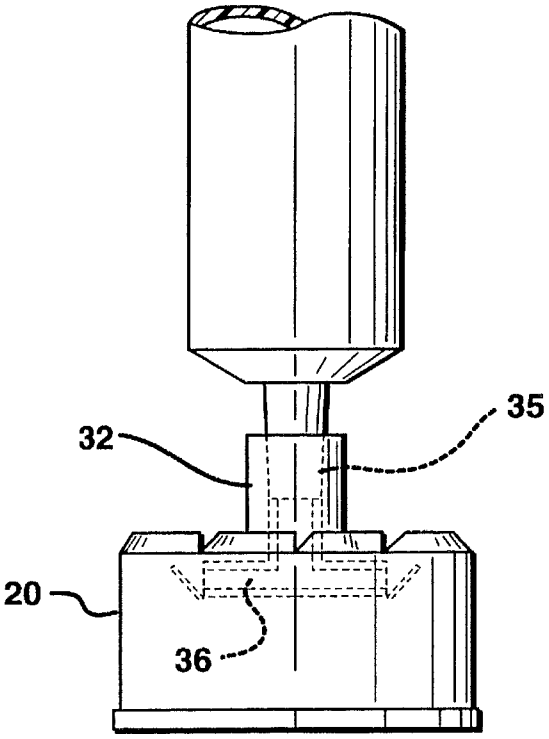
FIG. 3 is a side view illustrating a standard tip, non Luer-Lok syringe connected to the dispensing port according to the present invention.

In an additional embodiment, as can be seen in FIG. 3, tubular stem 32 is a straight shaft without flange 34. In this embodiment, a syringe of the Luer-Lok design fits down over tubular stem 32 in a press fit attachment rather than being rotatably attached. A syringe of the standard-tip, non Luer-Lok design functions in the same manner as before with a press fit internal adaption 35. Either the rotational attachment via flange 34 or press fit attachment via internal adaption 35 allows a liquid impermeable seal to be formed between the syringe tip and the dispensing port. Medication can then be drawn into the syringe by aspirating the liquid into the syringe.

Figure 4:
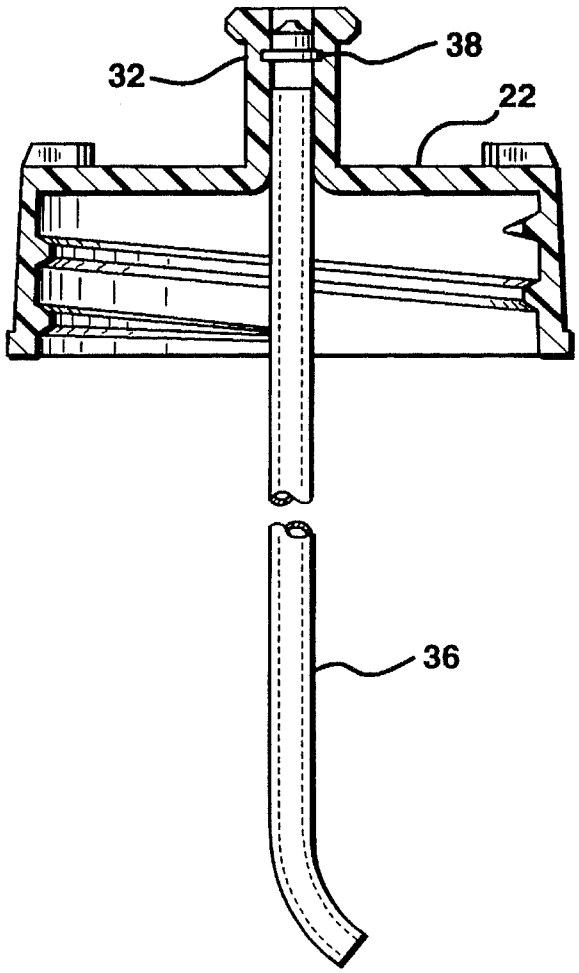
FIG. 4 is a sectional view illustrating the tube of the dispensing port extending to the bottom of the container according to one embodiment of the present invention.

Returning to FIG. 1, dispensing port 30 also includes a tube 36 attached at a first end to tubular stem 32. At a second end, tube 36 may undertake several configurations. The first, and preferred, configuration is having tube 36 being forked or branched on the underside of top panel 22 as shown in FIG. 1. This configuration will help prevent spillage if the container is tipped and will allow maximum use of all the liquid in the container. A second configuration is depicted in FIG. 4. In this configuration, tube 36 is extended to the bottom of the container when the closure is secured on the container. This configuration allows liquid to be aspirated from the container without inverting the container. In additional configurations, the second end of tube 36 can be straight or in the shape of an elbow.

Optionally, as shown in FIG. 4, tubular stem 32 may also include a flow control device 38, such as for example a valve, in the tube. Such a flow control device would be placed into an open position allowing liquids to pass through when a syringe tip is secured to tubular stem 32. When the syringe tip is not secured to tubular stem 32, the flow control device is in a closed position thereby blocking the passage of fluids through tubular stem 32. The optional flow control device can be used with any configuration of tube 36 or either the rotational attachment embodiment or the press fit attachment embodiment.

The closure 10 of the present invention, also includes a cap 40 encircling the coupling 20. The cap 40 can be molded to be an extension of annular skirt 24 (not shown) or cap 40 can be designed as the second outer piece of the preferred two-piece closure. As shown in FIG. 1, cap 40 includes plug 41 and outer barrel member 42. Plug 41 is a extension of the cap and manufactured to frictionally fit into tubular stem 32. Thus, when cap 40 is closed, plug 41 seals tubular stem 32 and prevents spillage of liquid from the container.

Outer barrel 42 has an annular side wall 44, a base portion 46, and internally extending flange 48 and a lid 52 spanning the top of annular side wall 44. Base 46 is formed as a lip-type extension on the bottom of annular side wall 44. Base 46 functions to keep outer barrel 42 from being pulled up and over coupling 20. Thus, base 46 maintains the integrity of the two-piece design. Side wall 44 extends upward from the base and completely encircles coupling 20. Side wall 44 is designed to be higher than the combination of dispensing port 30 extending upward from top panel 22. Outer barrel 42 is designed so that it is capable of freely rotating around coupling 20. However, outer barrel 42 has limited axial movement either horizontally or vertically.

Outer barrel 42 also includes an internally extending flange 48. Internal flange 48 is positioned slightly higher than top panel 22 and extends inwardly toward dispensing port 30. Internal flange 48 can extend any distance sufficiently long enough to overlap coupling 20. However, it preferably extends inward as close as possible to dispensing port 30 in order to provide added strength and support to the flange.

Figure 5:
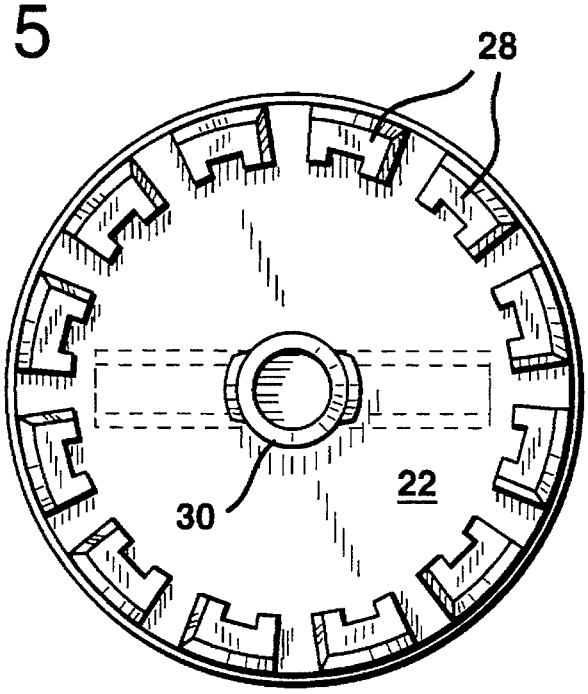
FIG. 5 is a top view of the coupling illustrating the dispensing port and engagement members according to the preferred embodiment of the present invention taken along the line 5—5 in FIG. 2.

As mentioned previously, the preferred two-piece closure of the present invention includes dual child-resistant mechanisms. The first child-resistant mechanism is a "push and turn" removal mechanism for closure 10. Again referring to FIG. 1, coupling 20 has provided on top panel 22, a plurality of engagement members 28. As can be seen in FIG. 5, engagement members 28 are placed in a circular manner around the edge of top panel 22. The internally extending flange 48 of outer barrel 42 has disposed on the surface opposing top panel 22 a plurality of complimentary engagement members 50.

The "push and turn" mechanism is designed such that when outer barrel 42 is rotated, it slides freely around coupling 20. However, if outer barrel 42 is depressed, complimentary engagement members 50 engage engagement members 28 on top panel 22. This causes outer barrel 42 and coupling 20 to interlock and to move in conjunction with each other. In this fashion, closure 10 can be removed from the container only by an individual with sufficient knowledge and motor skills to push down on the outer barrel while rotating it, which usually excludes small children.

Figure 6:
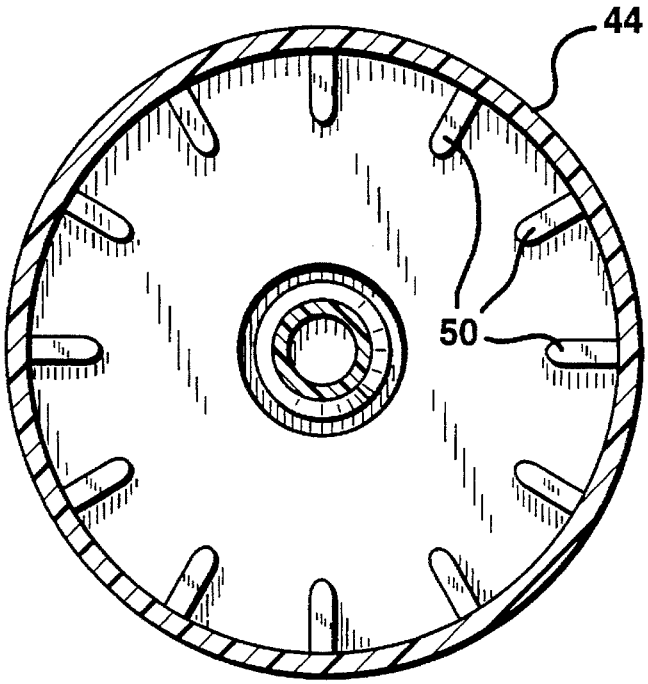
FIG. 6 is a horizontal sectional view illustrating the internally extending flange with engagement members according to the preferred embodiment of the present invention taken along line 6—6 in FIG. 1.

Engagement members 28 and 50 may be selected from ridges, ribs, inclined planes, fins or any other shape suitable for the purpose. Preferably, engagement members 28 are ridges having a notch in the middle and an inclined camming surface on one end, as is shown in FIG. 5. Complimentary engagement members 50 are preferably ribs or fins, as is shown in FIG. 6. In operation the engagement members 50 will slide up the inclined camming surface over the ridge of engagement members 28 when the outer barrel 42 is rotated. When outer barrel 42 is depressed and rotated, the ribs of engagement members 50 slide up the inclined camming surface and drop into the notch on the ridges of engagement members 28 thereby interlocking outer barrel 42 and coupling 20.

Figure 7:
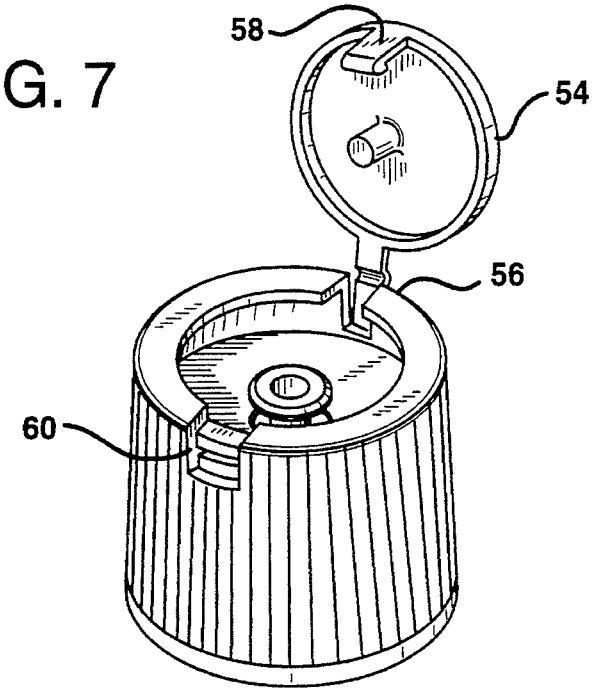
FIG. 7 is a perspective view illustrating the closure in accordance with the preferred embodiment of the present invention.

The second child resistant mechanism of the preferred dual child resistant embodiment involves the lid 52 of cap 40. Lid 52 is adapted for movement between open and closed positions. Lid 52 may be any means suitable for spanning the top of outer barrel. Referring to FIG. 7, there is seen a perspective view of the closure of the present invention. Preferably, lid 52 comprises a flap 54 permanently attached to annular side wall 44 by means of a hinge 56, joint, pivot or other suitable attaching means. The means for permanently attaching the flap can be located at the top of side wall 44, intermediate on the side wall, or internally and is preferably a hinge. Flap 54 has a fastener 58 attached to the end opposite of the attachment to annular side wall 44. Fastener 58 may comprise a hook, clip, clasp or any suitable fastening device.

Figure 8:
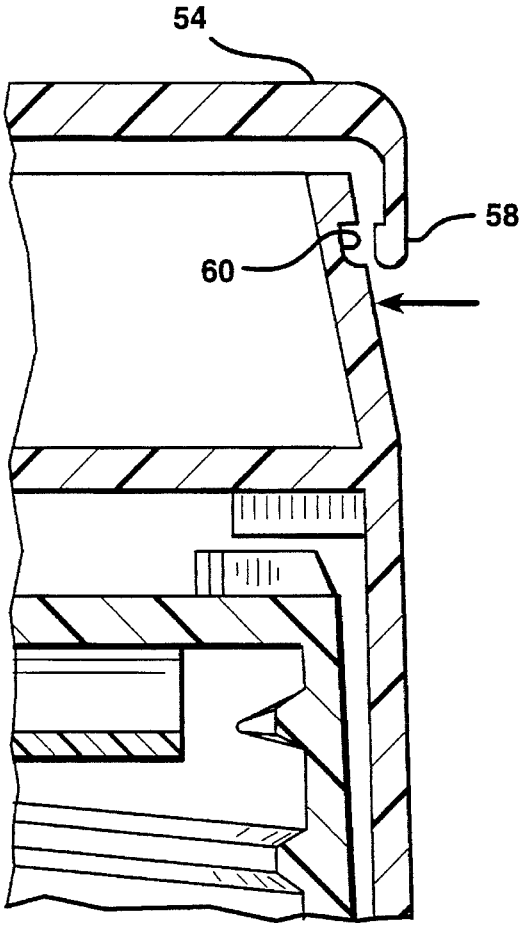
FIG. 8 is a sectional view illustrating the fastener, notch and flexible annular side wall according to the preferred embodiment of the present invention.

Fastener 58 is adapted to latch to annular side wall 44. This comprises the second child resistant device. Fastener 58 latches to at least one notch 60 molded into annular side wall 44 opposite to the point of attachment of hinge 56. This second child-resistant device is operated by depressing side wall 44 near where fastener 58 is latched to notch 60, as is shown in FIG. 8. Depressing the side wall releases fastener 58 from notch 60 and flap 54 can then be raised thereby gaining access to dispensing port 30.

Closure 10 of the present invention can be manufactured from any suitable material but is preferably polymeric plastic which is easily moldable such as a thermoplastic resin. Closure 10 is made of a suitable thickness of material in order to impart sufficient rigidity to coupling 20 and internal flange 48 of outer barrel 42. Annular side wall 44 is manufactured to a thickness such that there is sufficiently rigidity to allow a small amount of torque to be placed upon it while closure 10 is being removed from a container. However, the portion of annular side wall near notch 60 is manufactured to be more flexible than the remainder of the side wall. This is to allow this portion of the side wall to be depressed so that fastener 58 may be released from notch 60. This may be accomplished by any suitable means such as a thinner wall or more flexible plastic composition.

The closure of the present invention can be designed for use on any size container including 2, 3, 4, 6, 8, 12, 16 and 32 ounce stock bottles. The closure is suitable for use with any liquid which is dispensed from a syringe, particularly oral liquid medications such as antibiotic suspensions, OTC cold syrups and antipyretics. Further, the closure is useable with most commercially available syringes for dispensing oral medication such as those of the Luer-Lok design or standard tip, non Luer-Lok design. Additionally, the closure of the present invention is completely removable for pouring medication into other dispensing means if so desired or for reconstitution of powdered contents, if necessary.

Thus, the closure of the present invention provides a closure with dual child-resistant capabilities and dual functionality (medication can be dispensed by pouring or by aspirating into a syringe). The closure of the present invention reduces contamination of medication in the container, reduces the chance of spillage and provides for maximal use of all medication in the container. The closure is especially useful for aspirating liquid medication into a syringe for oral administration to children, adults or animals.

Having described the invention in detail and by reference to the preferred embodiments thereof, it will be apparent that modifications and variations are possible without departing from the scope of the invention which is defined in the appended claims.

What is claimed is:

1. A container closure having a syringe tip connector comprising:

a coupling for securing said closure to an opening in a container and adapted to allow said closure to be removed from said container, said including a laterally extending top panel, and an annular skirt descending from said top panel, said annular skirt including internally extending ridges for rotatably securing said closure to said container;

a dispensing port in said closure for releasably connecting the tip of a syringe, said dispensing port including a tubular stem which protrudes from said coupling and adapted to engage said tip of said syringe and provide a liquid impermeable seal between said dispensing port and said syringe tip; and, a cap encircling said coupling and adapted for movement between open and closed positions, said cap including an outer barrel member adapted to fit over said coupling with free rotation and limited axial movement, said outer barrel member and said coupling acting in conjunction with one another to form a child-proof mechanism and a plug member in said cap which sealably engages said dispensing port when said cap is in a closed position.

2. The container closure as claimed in claim 1 wherein said dispensing port further includes a flange extending outwardly from said tubular stem for rotatably engaging said tip of said syringe.

3. The container closure as claimed in claim 1 wherein said dispensing port further includes a tube having first and second ends, said first end engages said tubular stem, and said second end extends downwardly through said coupling.

4. The container closure as claimed in claim 3 wherein said second end is furcated.

5. The container closure as claimed in claim 3 wherein said tube includes a flow control device.

6. The container closure as claimed in claim 3 wherein said tube extends to the bottom of said container when said closure is secured on said container.

7. The container closure as claimed in claim 1 wherein said outer barrel member comprising a base portion encircling said coupling, an upwardly extending annular side wall and an internally extending flange intermediate to said base portion and said upwardly extending side wall, and a lid spanning said upwardly extending side wall.

8. The container closure as claimed in claim 7 wherein said top panel of said coupling includes engagement members and said internally extending flange of said outer barrel member has complementary engagement members opposing said engagement members on said top panel such that when said outer barrel member is depressed and rotated said complimentary engagement members interlock causing said coupling and said outer barrel member to move in conjunction with each other.

9. The container closure as claimed in claim 7 wherein said lid comprises a flap hinged to said annular side wall, said flap including a fastener on a distal end which is and adapted for latching to the opposite side of said annular wall.

10. The container closure as claimed in claim 9 wherein said annular side wall of said outer barrel member is notched to receive said fastener, said notched annular side wall being thinner than the remaining portions of said annular side wall so that said annular side wall is flexible and can be depressed to release said fastener from said notch.

11. A container closure having a syringe tip connector comprising:

a coupling for securing said closure to an opening in a container and adapted to allow said closure to be removed from said container, said coupling including a laterally extending top panel, engagement members on said top panel, an annular skirt descending from said top panel, and said annular skirt has internally extending ridges for rotatably securing said closure to said container;

a dispensing port in said top panel for releasably connecting the tip of a syringe, said dispensing port including a tubular stem which protrudes from said top panel adapted to engage said tip of said syringe and provide a liquid impermeable seal between said dispensing port and said syringe tip; and, a cap encircling said coupling, said cap including an outer barrel member adapted to fit over said coupling with free rotation and limited axial movement, said outer barrel member comprising a base portion encircling said coupling, an upwardly extending annular side wall and an internally extending flange intermediate to said base portion and said upwardly extending side wall, complementary engagement members on said internally extending flange opposing said engagement members on said top panel, a lid spanning said upwardly extending side wall and adapted for movement between open and closed positions, and a plug member connected to said lid which sealably engages said dispensing port when said lid is in a closed position.

12. The container closure as claimed in claim 11 wherein said dispensing port further includes a flange outwardly extending from said tubular stem for rotatably engaging said tip of said syringe.

13. The container closure as claimed in claim 12 wherein said dispensing port further includes a tube having first and second ends, said first end engages said tubular stem, and said second end extends downwardly through said coupling.

14. The container closure as claimed in claim 13 wherein said second end is furcated.

15. The container closure as claimed in claim 13 wherein said tube includes a flow control device.

16. The container closure as claimed in claim 13 wherein said tube extends to the bottom of said container when said closure is secured on said container.

17. The container closure as claimed in claim 11 wherein said lid comprises a flap hinged to said annular side wall, said flap including a fastener on a distal end which is adapted for latching to the opposite side of said annular side wall.

18. The container closure as claimed in claim 17 wherein said annular side wall of said outer barrel member is notched to receive said fastener, said notched annular side wall being thinner than the remaining portions of said annular side wall so that said annular side wall is flexible and can be depressed to release said fastener from said notch.

19. In combination a container closure having a syringe tip connector and syringe comprising:

(a) a container closure comprising a coupling for securing said closure to an opening in a container and adapted to allow said closure to be removed from said container, said coupling including a laterally extending top panel, and an annular skirt descending from said top panel, said annular skirt including internally extending ridges for rotatably securing said closure to said container;

a dispensing port in said closure for releasably connecting the tip of a syringe, said dispensing port including a tubular stem which protrudes from said coupling and adapted to engage said tip of said syringe and provide a liquid impermeable seal between said dispensing port and said syringe tip; and, a cap encircling said coupling and adapted for movement between open and closed positions, said cap including an outer barrel member adapted to fit over said coupling with free rotation and limited axial movement, said outer barrel member and said coupling acting in conjunction with one another to form a child-proof mechanism and a plug member in said cap which sealably engages said dispensing port when said cap is in a closed position, and;

(b) a syringe having a syringe tip connected to said dispensing port.

* * * * *

UNITED STATES PATENT AND TRADEMARK OFFICE

CERTIFICATE OF CORRECTION

PATENT NO. : 5,484,070
DATED : January 16, 1996
INVENTOR(S) : D. Scott Graham

It is certified that error appears in the above-indentified patent and that said Letters Patent is hereby corrected as shown below:

Column 7, line 29, "said including" should be

--said coupling including--.

Signed and Sealed this

Eleventh Day of June, 1996

*Attest:*

BRUCE LEHMAN

*Attesting Officer*

*Commissioner of Patents and Trademarks*